United States Patent [19]

File

[11] 4,205,778

[45] Jun. 3, 1980

[54] MAIL DELIVERY SIGNAL WITH FLAT SIGNAL PLATES

[76] Inventor: Robert H. File, 3508 N. 63rd St., Scottsdale, Ariz. 85251

[21] Appl. No.: 870,565

[22] Filed: Jan. 18, 1978

[51] Int. Cl.[2] ..... A47G 29/12

[52] U.S. Cl. ..... 232/35; 232/34

[58] Field of Search ..... 232/34, 35

[56] References Cited

U.S. PATENT DOCUMENTS

| | | | |
|---|---|---|---|
| 707,554 | 8/1902 | Coursen | 232/35 |
| 870,654 | 11/1907 | Weston et al. | 232/34 |
| 2,581,880 | 1/1952 | Price | 232/35 |
| 2,864,553 | 12/1958 | Petrie | 232/35 |
| 3,408,978 | 11/1968 | Duffey | 232/35 |
| 3,815,811 | 1/1973 | Harmon | 232/35 |
| 3,904,108 | 9/1975 | File | 232/35 |
| 3,960,316 | 6/1976 | Echterling | 232/35 X |

*Primary Examiner*—Ramon S. Britts

*Assistant Examiner*—Peter A. Aschenbrenner

*Attorney, Agent, or Firm*—Clarence A. O'Brien; Harvey B. Jacobson

[57] ABSTRACT

A mail box signal device for attachment to a rural mailbox, the invention comprises a length of flexible cord-like material mounted interiorly of the mailbox and fitting within guide structure mounted within the box. A first end of the cord-like material has a flexible flap attached thereto, the flap being retentively but releasably lodged between the door and open end edge of the mailbox. Flat signal plates attached to the opposite ends of the cord-like material are held contiguous against the underside of the mailbox when the device is a set or non-signalling position, the signal plates dropping downwardly on opening of the door of the mailbox thereby to release the flap and attached length of cord-like material. Movement of the flat signal plates to a downwardly disposed position indicates to a distant observer that the mailbox has been opened.

2 Claims, 4 Drawing Figures

MAIL DELIVERY SIGNAL WITH FLAT SIGNAL PLATES

BACKGROUND OF THE INVENTION

1. Field of the Invention

The invention generally relates to signal devices for indicating that a mailbox has been opened.

2. Description of the Prior Art

It is not uncommon for mailboxes, particularly rural mailboxes, to be located adjacent a road or street at a considerable distance from the house or building with which the mailboxes are associated. Absent an indication to the owner of such a mailbox that the box has been opened, the owner often can make a number of daily trips to the mailbox in order to determine whether mail has been delivered. In order that such fruitless trips may be avoided, the prior art has provided a number of devices which provide a visual signal that a mailbox has been opened. The common flag devices which are pivotally connected to exterior surfaces of a mailbox require that the individual depositing mail within the box move the flag device to a given position in order to notify the owner of the box that mail has been deposited therein. Such devices require the active participation and cooperation of the individual depositing mail within the box, the work load of such individuals often being such that the time cannot be taken to provide this service. Accordingly, signaling devices not requiring the consenting participation of the individual depositing mail in the box have been devised. For example, File, in U.S. Pat. No. 3,904,108, provides a weighted signal member attached to a flexible cord, one end of the cord being held between the door of the box and an open end edge thereof, opening of the door of the box releasing the cord to allow the weight to drop to a position visible from a distance to an observer. Lawson, in U.S. Pat. No. 2,609,787, provides a rural mailbox signalling structure intended to be clearly visible from a point distant from the position of the mailbox and which is operable by the opening of the mailbox door, the device being operable without requiring the attention of the individual depositing mail within the box. The present invention provides a structure having the advantages of such prior art structures and further being less susceptible to jamming of the several portions of the device, the signalling portions of the device particularly being disposed in positions surmounted by the mailbox itself, thereby to prevent malfunction of the device by contact with ice and snow.

SUMMARY OF THE INVENTION

The present invention provides a mailbox signalling device actuable on opening of a mailbox door, the signal device not requiring the active intentional participation of the individual depositing mail within the box. The present invention, therefore, advances the art by providing an aid to the mail carrier and patron, whereby to more satisfactorily coordinate their mutual efforts and minimize the need for fruitless trips to a distant mailbox as is a presently accepted but unsatisfactory practice. The present device can be installed within a standard rural mailbox without modification to the basic structure of the mailbox, the present device essentially comprising an attachment to the mailbox. The present device is comprised of an elongated flexible element, such as a length of cord, having a forward end, a rearward end, and an intervening median or body portion. A flexible flap of material is securely fastened to and cooperable with the forward end of the cord, the flap being positioned between the door and a perimetric edge portion of the open end of the mailbox when the present device is in a "set" position. The flap is retained in such a position until the door is intentionally opened, such as by a mail carrier intending to deposit mail within the box. Weighted signal plates fastened to the rearward end of the cord drop downwardly on release of the flap to pull the cord in a slidable fashion through guide structure mounted interiorly of the mailbox. The guide structure particularly comprises a length of tubular material formed in a shape conducive to guiding the flexible cord in a desired fashion. The rearward end of the cord, which rearward end may be bifurcated in order that more than one of the signal plates may be attached thereto in different locations in surmounted relation to the mailbox, extends through an aperture formed in the floor of the mailbox and joins to free ends of the signal plates externally and beneath the mailbox. The signal plates are hingedly connected along lateral edges thereof oppositely to and spaced from the point of connection of the rearward end of the cord to said plates. The signal plates are of sufficient weight such that the free ends of said plates, the free ends being the ends to which the rearward end of the cord is attached, drop downwardly on release of the flap on the forward end of the cord from the "set" position thereof between the door of the mailbox and the edge portion of the open end thereof. The signal plates thus fall from a position adjacent to the underside of the mailbox to a position beneath the mailbox whereby the signal plates are readily visible to an observer.

The present signalling device may be installed within a conventional rural mailbox with only minor modifications to the mailbox. Further, the present signalling device does not impede the delivery of mail or interfere with withdrawal of mail from the box. The signalling plates of the invention are of such construction that the plates can be seen from all aspect angles relative to the box when the plates are in the "signalling" position, the plates being held against the underside of the mailbox to prevent visual observation thereof when the mailbox is in the "set" position.

Accordingly, it is an object of the present invention to provide a mailbox signalling device which visually indicates the presence of mail in the mailbox as a result of the mailbox door having been opened.

It is another object of the present invention to provide a visual mailbox signalling device which can be readily installed within the interior of a rural mailbox without substantial modification thereto.

It is a further object of the invention to provide a visual mailbox signalling device comprised of flat signal plates disposed in surmounted relation to the mailbox, the signalling plates being located beneath the mailbox in both the non-signalling and signalling positions in order that environmental conditions do not act to interfere with the operation of the device.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
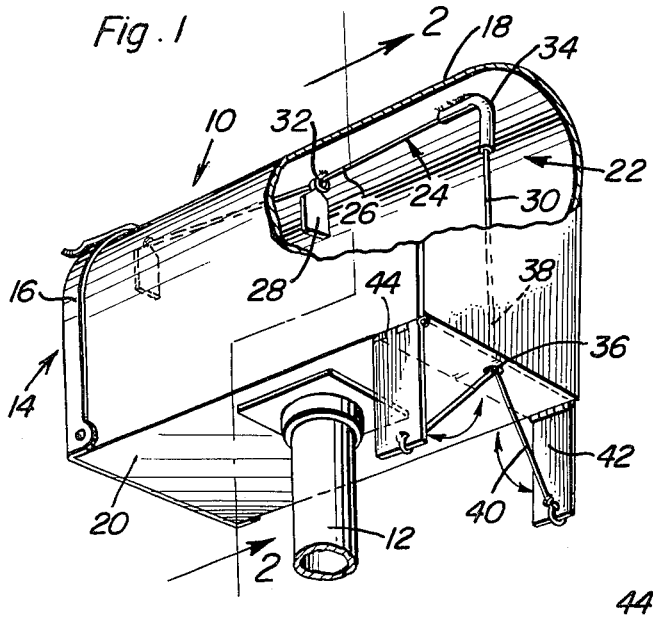
FIG. 1 is a perspective view partially cut away of a rural mailbox fitted with the signalling device of the invention, the configuration of the signalling device being shown in a signalling position, phantom lines illustrating the relative positions of the several elements of the device when in a non-signalling position.
Figure 2:
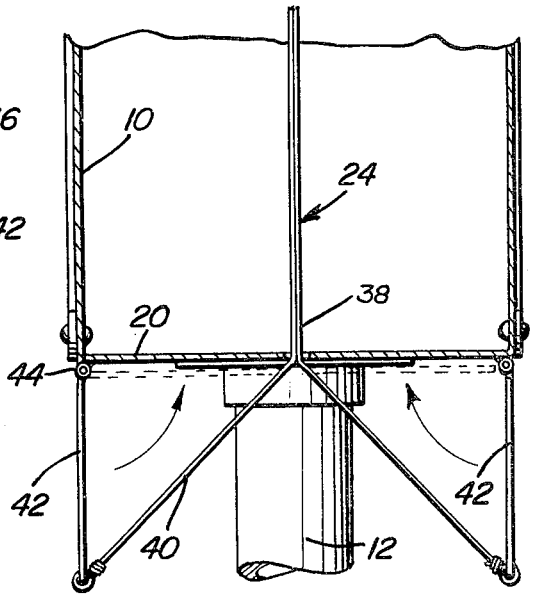
FIG. 2 is a sectional view taken along line 2—2 of FIG. 1.

Referring now to the drawings and particularly to FIGS. 1 and 2, a standard rural mailbox is shown generally at 10 to be mounted in a conventional fashion to a support post 12. The mailbox 10 is provided with a conventional door 14 which is hingedly mounted to the mailbox 10 at a lower edge portion of the open end of the box 10. The door 14 is formed in a conventional manner and acts to close the cooperating open front end of the box. The door 14 is further provided with conventional flanges 16 which extend inwardly of the box 10 to encompass peripheral edge portions of the open end of the box. The box 10 is conventionally comprised of an arcuate roof 18 and a conventional planar floor 20.

The signal device of the present invention is seen generally at 22 to have the major active portions thereof mounted interiorly of the mailbox 10, the signal device 22 comprising an elongated flexible element, such as a cord 24, a forward end portion 26 of the cord 24 having a flexible flap 28 attached thereto. Median portions 30 of the cord 24 are threaded through and are slidably received within guide structures mounted within the interior of the mailbox 10. These guide structures include a guide-eye 32 mounted on the inner surface of the roof 18 at a point substantially midway of the length of the box 10. A tubular guide member 34 having an arcuate configuration has a first end extending toward the guide-eye 32, the tubular guide member 34 curving medially of its length to terminate in a downwardly extending second end which aligns with an aperture 36 formed in the floor 20 of the box 10. The cord 24 is thus received through the guide-eye 32 and the tubular guide member 34, the direction of the cord 24 being altered by passage through the guide member 34. The forward end portion 26 of the cord 24 is seen to extend substantially horizontally while rear end portion 38 extends substantially vertically toward and through the aperture 36 in the floor 20. The rear end portion 38 is seen to be bifurcated to form two trailing portions 40, the free end of each trailing portion 40 being respectively secured to free ends of signal plates 42. The signal plates 42 are disposed one each on each side of the floor 20 of the box 10, hinges 44 connecting the plates 42 to the underside of the box 10 for pivotal movement relative thereto. Accordingly, the signal plates 42 can be pivoted about the hinges 44 to a position contiguous to the underside of the floor 20, the signal plates 42 being thus disposed in a position not visible to a distant observer. When the flap 28 on the forward end portion 26 of the cord 24 is disposed forwardly of the mailbox 10 and secured between the door 14 and perimetric edge portions of the open end of the mailbox 10, the cord 24 holds the signal plates 42 in a contiguous underlying relation to the underside of the floor 20. When the door 14 is opened, the weight of the signal plates 42 causes the free ends of said plates to drop downwardly, thereby pulling the cord 24 through the guide-eye 32 and tubular guide member 34 to displace the flap 28 rearwardly and toward the guide-eye 32. The signal plates 42 thus fall into the visually exposed position shown in FIGS. 1 and 2, the disposition of the signal plates 42 in the downwardly extending position thus shown indicating that the door 14 of the mailbox 10 has been opened. Resetting of the signal device 22 is readily accomplished by reaching into the interior of the mailbox 10 and grasping the flap 28, the flap 28 being pulled forwardly along with the cord 24 to again dispose the flap 28 between the door 14 and perimetric edge portions of the open end of the mailbox 10. Displacement of the cord 24 in this manner draws the trailing portions 40 of the cord 24 through the aperture 36 in the floor of the box and thus causes the signal plates 42 to pivot about the hinges 44 and move into positions contiguous to the underside of the floor 20. The signal plates 42 may be colored or otherwise provided with reflective or luminous substances such that the plates 42 can be more readily observed.

Figure 3:
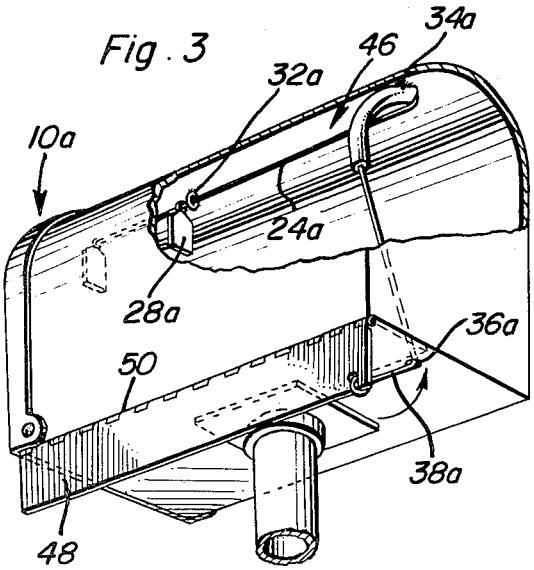
FIG. 3 is a perspective view of a second embodiment of the invention.
Figure 4:
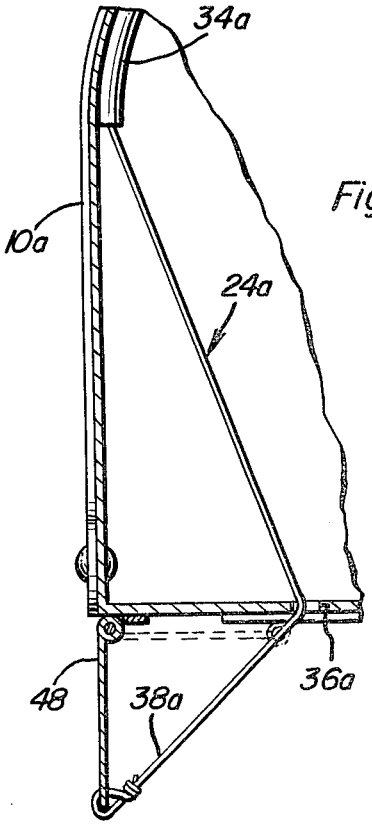
FIG. 4 is an elevational view in section of a portion of the structure of FIG. 3.

As can be seen in FIGS. 3 and 4, a second embodiment of the invention is shown to comprise a signal device 46 similarly formed of a cord 24*a* having a flap 28*a* attached to a forward end thereof. The cord 24*a* extends through a guide-eye 32*a* and a tubular guide member 34*a* mounted to mailbox 10*a* in a manner similar to that described hereinabove. The tubular guide member 34*a*, however, is disposed within the mailbox 10*a* in a laterally extending sense, the plane of the opening in the end of the tubular guide member 34*a* nearmost the guide-eye 32*a* being substantially parallel to the forward end portion of the cord 24*a*. On insertion through the tubular guide member 34*a*, the cord 24*a* undergoes a reversal of direction to extend downwardly within the mailbox 10*a* through an aperture 36*a* formed in the floor of the mailbox 10*a*. Rear end portion 38*a* of the cord 24*a* is attached to a signal plate 48 at one end thereof, the signal plate 48 extending substantially the length of the mailbox 10*a* along a lower side edge thereof. A hinge 50 pivotally attaches the signal plate 48 to the box in a manner similar to that described hereinabove. The operation of the signal device 46 is substantially identical to that of the signal device 22, the signal plate 48 being drawable contiguously against the underside of the floor of the box 10*a* on displacement of the forward end portion of the cord 24*a* forwardly of the box 10*a*. Similarly, opening of the door of the box 10*a* releases the flap 28*a*, the weight of the signal plate 48 causing the cord 24*a* to be displaced through the guide-eye 32*a* and tubular guide member 34*a*, the free end of the signal plate 48 pivoting downwardly of the underside of the box 10*a* into a position which can be readily observed from a distance. It is to be understood that the signal plates 42 and 48 can be formed of any desired material such as sheet metal, vinyl and even cloth, relatively lightweight materials being preferably weighted at the free ends thereof to insure pivotal movement of the plates on opening of the mailbox.

Also, the guide eye 32 may be omitted and the end of the tubular guide member 34 used to stop the fall of the signal by forming a knot in cord 24 at an appropriate location which will engage the end of guide member 34. The guide member 34 is better able to withstand the forces exerted by stopping cord 24 as compared to eye 32 since the vertical portion thereof rests against and may be rigidly affixed to the rear wall of the mailbox.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a mailbox including a horizontal bottom wall having an aperture formed therein, vertical side walls, a horizontal top wall, a vertical end wall enclosing one end, and being open at its opposite mail inserting and removing end, a marginally flared door for closing said open end, said door being pivotally mounted on a coordinating end of said bottom wall and being adapted to swing outwardly and downwardly to uncover said open end, latching and retaining means on said door and mailbox, respectively, for securing said door in a closed position, a signal device mounted on the mailbox, including an elongated flexible cord, said flexible cord including a forward end, a rearward end, and an intervening median portion, a closed-door positioning and anchoring member attached to and cooperatively carried by said forward end and adapted to be retentively but releasably held, when said door is closed, between the door and portions of the mailbox, a guide structure mounted on said top wall of the mailbox adjacent its longitudinal center and retaining a portion of the cord adjacent the top wall, the remainder of the cord depending therefrom, a portion of the cord extending vertically alongside the end wall of the mailbox, the improvement comprising:

two plate members disposed on opposite lateral edges of the underside of the bottom wall and pivotally mounted thereto, the rearward end of the cord comprising bifurcations, one each of which extends to connect with free ends of one each of the plate members;

hinge means for pivotally mounting the plate members to the bottom wall, the plate members constituting a signal, the free ends of the plate members pivoting downwardly by virtue of the weight thereof on opening of the door to release the anchoring member, the plate member moving from a position contiguous to the underside of the bottom wall to a position disposed downwardly therefrom to visually indicate the opening of the mailbox;

said guide structure including a tubular guide member of arcuate configuration mounted to the horizontal top wall of the mailbox, a first upwardly disposed end of the tubular member extending toward the open end of the mailbox, the opposite end of the tubular member extending toward the bottom wall of the mailbox, the cord being slidably received within the tubular member and undergoing an alteration of direction therewithin.

2. In combination, a mailbox including a horizontal bottom wall having an aperture formed therein, vertical side walls, a horizontal top wall, a vertical end wall enclosing one end, and being open at its opposite mail inserting and removing end, a marginally flared door for closing said open end, said door being pivotally mounted on a coordinating end of said bottom wall and being adapted to swing outwardly and downwardly to uncover said open end, latching and retaining means on said door and mailbox, respectively, for securing said door in a closed position, a signal device mounted on the mailbox, including an elongated flexible cord, said flexible cord including a forward end, and an intervening median portion, a closed-door positioning and anchoring member attached to and cooperatively carried by said forward end and adapted to be retentively but releasably held, when said door is closed, between the door and portions of the mailbox, a guide structure mounted on said top wall of the mailbox adjacent its longitudinal center and retaining a portion of the cord adjacent the top wall, the remainder of the cord depending therefrom, a portion of the cord extending vertically alongside the end wall of the mailbox, the improvement comprising:

at least one substantially flat plate member mounted for pivotal movement to the underside of the bottom wall externally of the mailbox, a free end of the plate member being attached to the rearward end of the cord, the cord extending through the aperture in the bottom wall to attach to the plate member externally of the mailbox;

hinge means for pivotally mounting the plate member to the bottom wall, the plate member constituting a signal, the free end of the plate member pivoting downwardly by virtue of the weight thereof on opening of the door to release the anchoring member, the plate member moving from a position contiguous to the underside of the bottom wall to a position disposed downwardly therefrom to visually indicate the opening of the mailbox;

said guide structure including a tubular guide member of arcuate configuration mounted to the horizontal top wall of the mailbox, a first upwardly disposed end of the tubular member extending toward the open end of the mailbox, the opposite end of the tubular member extending toward the bottom wall of the mailbox, the cord being slidably received within the tubular member and undergoing an alteration of direction therewith; and wherein the flat plate member extends substantially along the full length of the lowermost edge of one of the vertical side wall.

* * * * *